US005979346A

United States Patent [19]

Rodriguez

[11] Patent Number: 5,979,346

[45] Date of Patent: Nov. 9, 1999

[54] AUTOMATIC STITCHING APPARATUS

[76] Inventor: Rosty Rodriguez, 1100 Norumbega, Monrovia, Calif. 91016

[21] Appl. No.: 09/042,390

[22] Filed: Mar. 12, 1998

[51] Int. Cl.[6] ..... D05B 29/00; D05B 35/10; D05B 27/08

[52] U.S. Cl. ..... 112/475.04; 112/260; 112/324; 112/153; 112/235

[58] Field of Search ..... 112/475.03, 475.04, 112/235, 240, 260, 324, 153

[56] References Cited

U.S. PATENT DOCUMENTS

| | | | |
|---|---|---|---|
| 1,864,452 | 6/1932 | Lutz | 112/235 X |
| 2,174,290 | 9/1939 | Max | 112/235 |
| 3,670,678 | 6/1972 | Zeigler | 112/235 |
| 4,848,256 | 7/1989 | Ohchi | 112/235 |
| 5,207,169 | 5/1993 | Mario | 112/235 X |
| 5,634,417 | 6/1997 | Katou | 112/235 |

FOREIGN PATENT DOCUMENTS

| | | | |
|---|---|---|---|
| 2484078 | 5/1981 | France | 112/235 |
| 261531 | 11/1988 | Germany | 112/235 |

*Primary Examiner*—Ismael Izaguirre
*Attorney, Agent, or Firm*—James E. Brunton

[57] ABSTRACT

A motor-driven sewing machine and method of making the same that includes a needle movable between advanced and retracted positions through a sewing station, a mechanism for controllably advancing the peripheral portion of a work piece past the sewing point and a mechanism for causing the sewing machine to apply stitches to the work piece border as the work piece automatically moves through the sewing station. The sewing machine is provided with a specifically configured feed dog and a presser foot which controllably moves the work piece along a work piece fence surface so that precisely configured stitches are expeditiously formed along the border of the work piece.

20 Claims, 6 Drawing Sheets

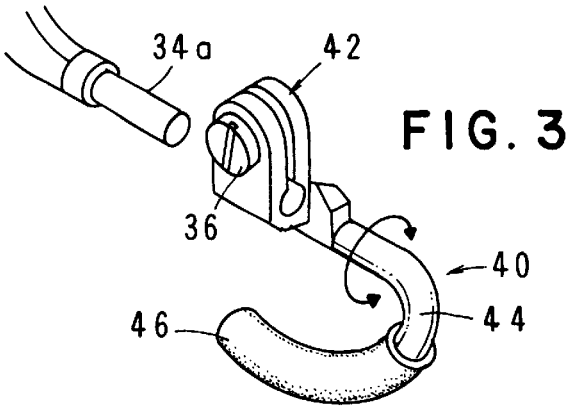
FIG. 3
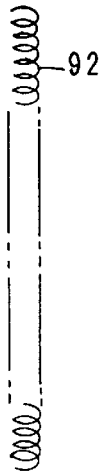
FIG. 6
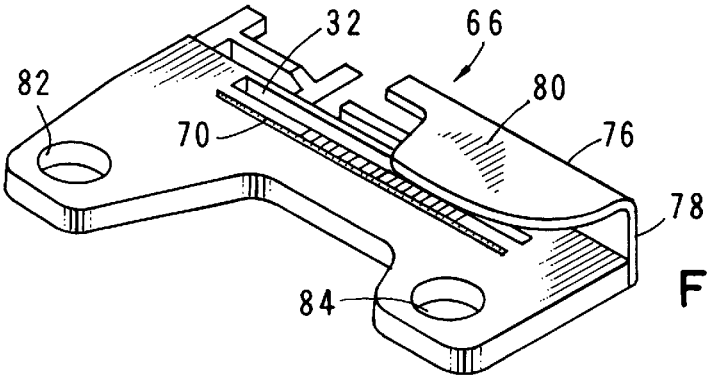
FIG. 4
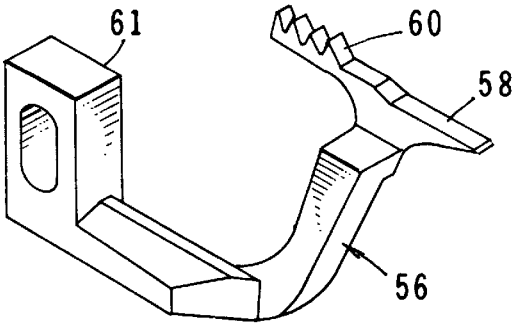
FIG. 5
FIG. 13
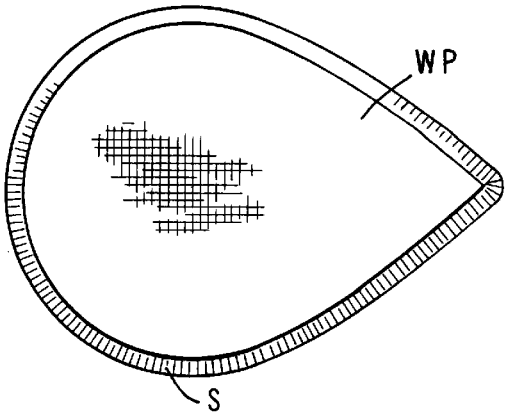

50
80
90
52
34
N
40
36
44
42
66
WP
80
76
82
46
S
84

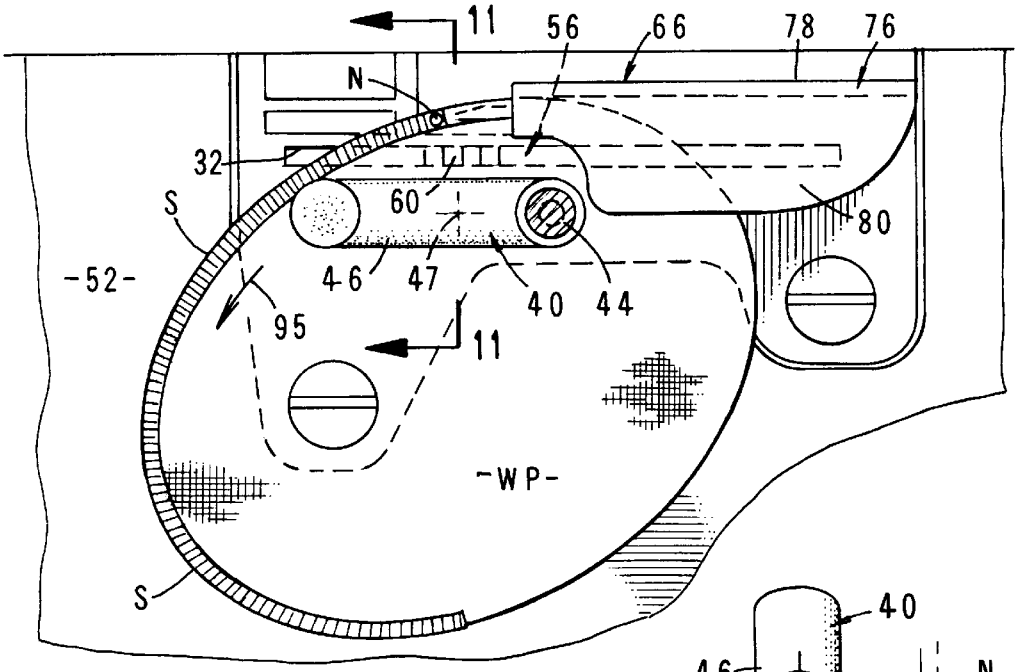
FIG. 10
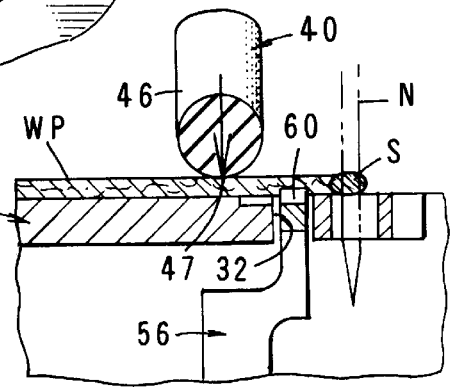
FIG. 11
FIG. 12
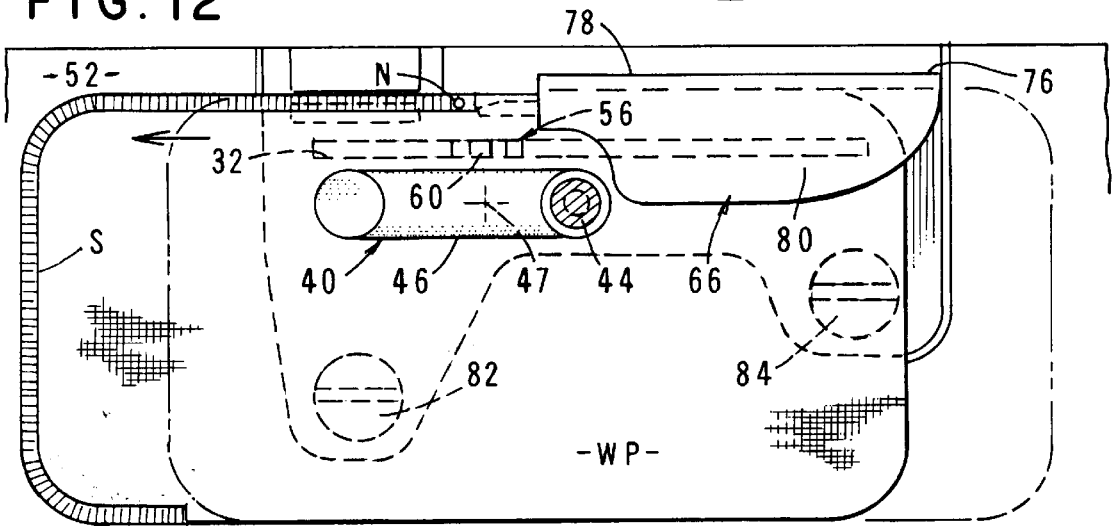

AUTOMATIC STITCHING APPARATUS

BACKGROUND OF THE INVENTION

1. Field of the Invention

The present invention relates generally to motor driven sewing machines. More particularly, the invention concerns an improved automatic stitching apparatus for automatically sewing the peripheral borders of work pieces of widely varying shapes.

2. Discussion of the Prior Art

Sewing machines are, of course, old in the art and have been designed to accomplish a wide variety of tasks such as utility stitching, decorative stitching, including appliqué, embroidery, merrow stitching and the like. Some prior art sewing machines are of relative simple construction for light sewing while others are more complex, heavy duty machines for commercial applications.

Regardless of the complexity of the particular machine, most prior art machines operate on basically the same principle and most include similar components such as a throat plate, a presser foot and feed dogs for moving the work piece relative to the needle and throat plate. Usually, stitches made by a conventional prior art sewing machine are formed by two threads which are interlocked. In the prior art vibrating shuttle type machine the upper thread is carried by the needle, while the under thread is unreeled from a bobbin. The descending needle penetrates the fabric and carries the thread along. When the needle rises again, the thread forms a loop on the underside of the fabric. The shuttle, which contains the bobbin of under thread passes through this loop and pulls the under thread along behind it. The shuttle thread is thus enclosed in the loop of the needle thread. The fabric is then moved forward usually by one or more feed dogs. During this forward movement, the needle remains stationary and the shuttle returns to its initial position. This causes the slack loop to be pulled tight so that the two threads interlock in the middle of the fabric. When the forward movement of the fabric stops, the operation is repeated. This method produces a so called lock stitch, which forms a strong but rather rigid seam.

The prior art chain-stitch type sewing machine on the other hand, produces seams having greater resilience. This type of prior art machine typically works with only one thread, which is linked at the underside of the fabric by means of a looper. A variant of this stitch is the overcast stitch which enwraps the edge of the material.

In the more modern domestic type motor driven sewing machines the so called rotary hook is frequently employed. In this type of machine the needle descends through the fabric, and the point of the hook advances to meet the needle. The return movement forms the loop, and the point of the hook enters it. The hook enlarges the loop, the front of which is held in a recess in the bobbin case, while the hook pulls away the other side of the upper thread loop over the bobbin case. The loop slips off the point of the hook while the thread take-up lever pulls the excess thread up again. During the unwinding of the thread, the side of the loop that was held in the recess is released and the loop is pulled tight.

In the typical prior art machine, rotary motion is transmitted through a top shaft to a crank drive for the thread take-up lever. In addition, the bottom shaft is driven by belts or gears from the top shaft. An eccentric cam mounted on the top shaft actuates eccentric rods and thus drives the feed mechanism or feed dogs which are positioned under a base plate and which functions to move the fabric forward. The stitch is made longer or shorter by varying the eccentric stroke and thus varying the amount of rotation that the feed motion shaft undergoes at each stroke.

Exemplary of one form of modern sewing machine is the device described in U.S. Pat. No. 4,250,824 issued to Meier et al. The method described in the Meier et al patent consists of a method for forming an overcast seam using a zigzag sewing machine with a needle bar carrying a needle with needle thread movable into first and second overstitch positions. The machine includes a looper with looper thread and a material feeder for feeding material in a feed direction. The method of the Meier et al disclosure comprises forming a first loop of needle and looper thread with the needle bar in its first overstitch position, moving the needle bar with needle thread into the second overstitch position leaving a loosened thread length between the first and second needle loop, forming a second loop of needle and looper thread with the needle in its second overstitch position forming at least one straight stitch with the needle bar in its second overstitch position in the feed direction of the material, pulling the loosened thread length between the first and second loops into the first overstitch position to form an overstitch loop into which the needle moves to from a subsequent loop, and releasing the overstitch loop.

U.S. Pat. No. 5,517,933 issued to Maraba, Jr. discloses a mechanism and method for forming a facing seam at a relatively high rate that will insure that the cover thread is properly interwoven between each stitch of two parallel rows of stitches. The facing seam is formed by two needles and cooperating loopers for forming two parallel rows of stitches that are joined by a cover thread that lies on the upper surface of the work piece. The cover thread is controlled by a conventional spreader and a cover thread assist member. The cover thread assist member is formed from a lightweight hardened wire that is fixed to a mid portion of the conventional spreader.

Somewhat more pertinent to the present invention is U.S. patent issued to Pirrello No. 3,675,602. This invention disclosed in this patent which is entitled, Automatic Emblem Sewing Machine relates to an improved sewing apparatus for automatically applying finishing stitches to the borders of successively feed work pieces such as cloth emblems. The Pirrello apparatus includes a sewing machine with an automatic needle positioner, a vacuum pickup mechanism for transferring an emblem from a stack of emblems to the sewing station, and an emblem guide mechanism including a servomotor-driven feed wheel laterally spaced from the sewing machine feed dog and controlled by an emblem edge sensor positioned rearwardly of the needle position. A stitch chain cutter actuated by the sewing machine trails the edge sensor and a stitch chain sensor trails the knife. A network controls the sequence of operations to raise the feed wheel and machine foot piece, transfer an emblem from the stack to the sewing station, to lower the wheel and foot piece, to start the sewing machine and to advance the emblem.

As will be better understood from the description which follows, the method of the present invention basically concerns the accomplishment of relatively simple but elegant modification, to a conventional type of commercially available sewing machine to enable the machine to automatically move the work piece, such as a cloth or plastic emblem, relative to the needle along a strategically positioned guide or fence in a manner to rapidly and precisely form virtually perfect finishing stitches along the border of the work piece. Although the finishing operation can be crudely accomplished using the unmodified machine, the operation is extremely time consuming and requires a high degree of operator skill which contributes greatly to the cost of the finished product.

SUMMARY OF THE INVENTION

It is an object of the present invention to provide an improved sewing apparatus. More particularly, it is an object of the invention to provide an improved automatic stitching apparatus for automatically forming along the peripheral borders of selected work pieces precisely tailored stitches.

Another object of the invention is to provide an improved apparatus of the aforementioned character in which the novel feed and presser mechanism of the apparatus automatically move the work piece along a strategically positioned edge guide, without the necessity of the operator physically guiding the work piece through the sewing cycle.

Another object of the invention is to provide an improved sewing apparatus for forming finishing stitches along the periphery of work piece of widely varying shapes which is easy to use and stitches both accurately and extremely rapidly.

Another object of the invention is to provide an apparatus of the character described in the preceding paragraphs which is highly reliable, versatile in operation and easily usable by non-skilled workers.

The foregoing and other objects of the present invention will become apparent from the following description taken in conjunction with the accompanying drawings which illustrate embodiment of the invention.

In summary, the apparatus of the invention comprises a motor-driven sewing machine including a needle movable between advanced and retracted positions through a sewing station, means for controllably advancing the peripheral portion of the work piece past the sewing point and means motivating said sewing machine to apply stitches to the work piece border as the work piece automatically moves through the sewing station.

In the preferred form of the improved apparatus of the invention, the sewing machine is provided with a specifically configured feed dog, and a presser foot of novel design which cooperate to controllably move the work piece along a work piece fence surface so that precisely configured stitches are expeditiously formed along the borders of the work piece.

BRIEF DESCRIPTION OF THE DRAWINGS

FIG. 3 is a generally perspective view of the modified prior art presser foot of the apparatus of the present invention.

FIG. 4 is a generally perspective view of the modified prior art throat plate of the apparatus of the invention.

FIG. 5 is a generally perspective view of the modified differential feed dog of the apparatus of the present invention.

FIG. 6 is a generally perspective view of the biasing means of the invention which biases the presser foot toward the work piece.

FIG. 10 is a view taken along lines 10—10 of FIG. 9.

FIG. 11 is a cross-sectional view taken along lines 11—11 of FIG. 10.

FIG. 12 is a top plan view similar to FIG. 10 but illustrating the stitching of a patch member of a generally rectangular rather than oval configuration.

FIG. 13 is a top plan view of still another configuration of patch member which can automatically be stitched about its periphery using the automatic stitching apparatus of the present invention.

DESCRIPTION OF THE INVENTION

The thrust of the present invention is to provide a method for modifying an existing, commercially available baseline motor driven sewing machine to produce a modified motor driven machine which will automatically form stitches along the periphery of work pieces of widely varying shapes and thicknesses with minimum operator involvement.

EXAMPLE 1

A readily commercially available motor driven sewing machine was first selected for modification in accordance with one form of the method of the invention. This machine which is manufactured by The Juki Company of Japan and sold under the model designation M0-2504 series, comprises a one needle, three thread overlock machine of relatively standard construction.

Figure 1:
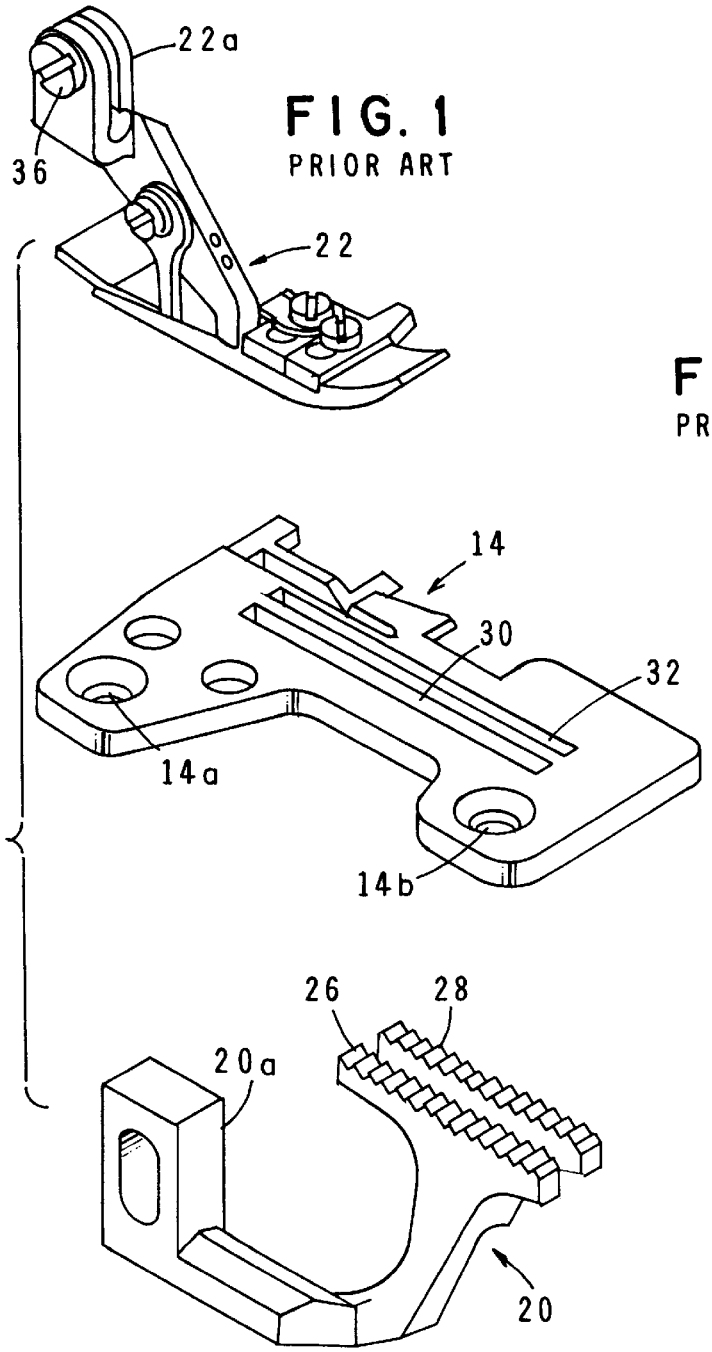
FIG. 1 PRIOR ART
FIG. 1 is a generally perspective, exploded view of various relatively standard components of a prior art sewing machine, including a presser foot, a throat plate and a differential feed dog.
Figure 2:
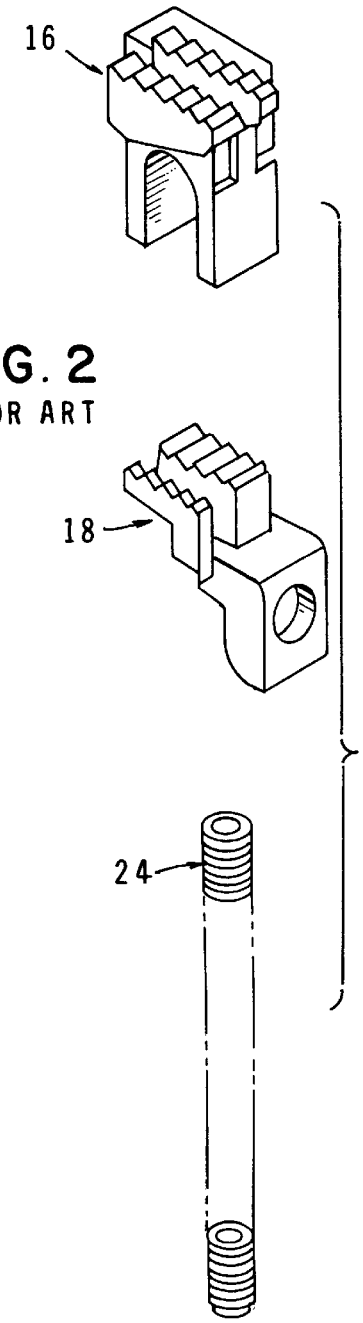
FIG. 2 PRIOR ART
FIG. 2 is a generally perspective, exploded view of other relatively standard components of a prior art sewing machine including a main feed dog, an auxiliary feed dog and a biasing spring for acting on the presser foot.

In addition to the reciprocating needle, the means for moving the needle through a sewing point located on a work surface, and the means for feeding thread to the needle, the baseline machine includes a throat plate the character shown in FIG. 1. The throat plate is connected to the work surface and is provided with first and second spaced apart feed dog receiving slots for receiving portions of the feed dogs of the invention, the character of which is shown in FIG. 2. A presser foot subassembly is disposed above the work surface and a biasing spring acts upon the assembly for continuously urging the presser foot in a direction toward the work surface.

The feed dogs of the Juki apparatus which include a main feed dog, an auxiliary feed dog and a differential feed dog function to advance the work piece relative to the needle. As shown in FIG. 1, the differential feed dog which is identified by the numeral 20, has first and second spaced apart rows of work piece engaging teeth receivable respectively in the first and second feed dog receiving slots formed in the throat plate.

Referring particularly to FIGS. 1 and 2 of the drawings, the throat plate of the baseline machine is generally identified by the numeral 14 (FIG. 1), the main dog is identified by the numeral 16, the auxiliary feed dog is identified by the numeral 18 (FIG. 2) and, as previously mentioned, the differential feed dog is identified by the numeral 20. (FIG. 1) Disposed above the throat plate of the baseline machine is a presser foot 22 which is continuously biased downwardly toward the work piece being sewn by a coiled biasing spring 24 (FIG. 2). It is to be observed that differential feed dog 20 is provided with two rows of teeth 26 and 28 which are closely received within two spaced apart slots 30 and 32 formed in throat plate 14.

Having selected the base line Venus motor driven sewing machine, the next step of the method of the invention is to remove from the base line machine for modification the throat plate 14 and the differential feed dog 20. The modification of these components will presently be described. Next, the main feed dog 16 and the auxiliary feed dog 18 are removed and discarded as is the presser foot subassembly 22 and the spring 24.

Figure 7:
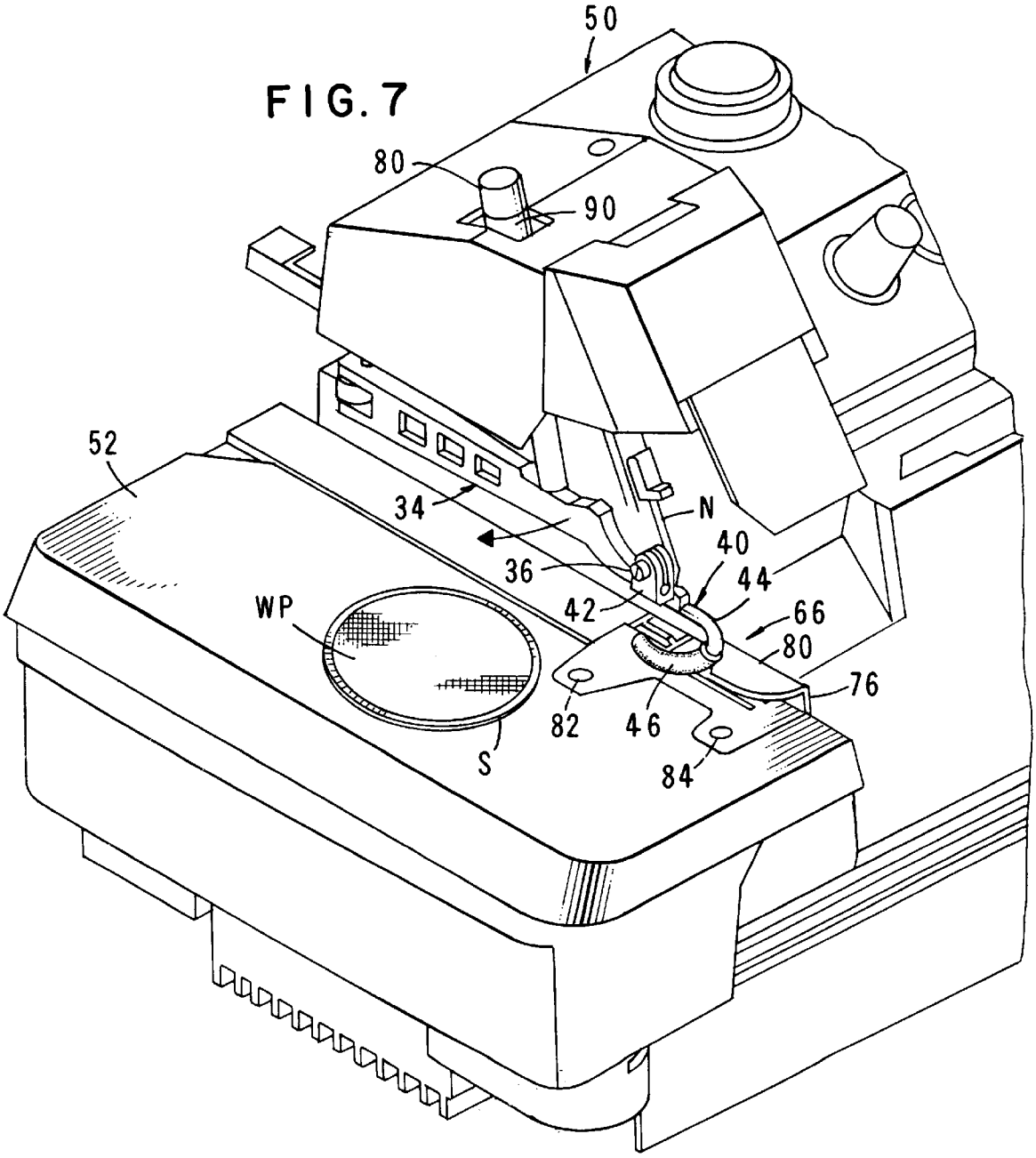
FIG. 7 is a generally perspective view of one form of the complete automatic stitching apparatus of the present invention.

By loosening set screw 36 (FIG. 1), the presser foot subassembly can next be removed from the pivotally movable support arm 34 of the baseline machine (FIG. 7). This done the novel modified presser foot or work piece engaging member of the present invention is connected to support arm 34 in the manner shown in FIGS. 7, 8, and 9. This uniquely constructed work piece engaging member, which is generally identified in the drawings by the numeral 40 comprises an important aspect of the apparatus of the invention since it, in cooperation with a guide fence provided on the modified throat plate, functions to cause the work piece to correctly travel through the sewing point of the apparatus.

Referring particularly to FIGS. 1, 3 and 7, the work piece engaging member 40 of the improved apparatus can be seen to comprise a connector portion 42, a curved body portion 44 which is connected to connector 42 and a yieldably deformable pressure imparting member 46 which is connect to member 44. In the form of the invention shown in the drawings member 46 is provided in the form of a yieldably deformable length of elastomeric tubing within which one end of the body portion 44 is telescopically received in the manner shown in FIG. 3. Comparing the structure shown in FIG. 3 with the prior art presser foot 22 shown in FIG. 1, it will be observed that the connector portion 22*a* of the presser foot 22 which includes a tightening screw 36 is identical to the connector portion 42 of work piece engaging member 40. As shown in FIG. 3, connector 42 is receivable over a generally cylindrically shaped end portion 34*a* of support arm 34. With this construction by loosening screw 36, the entire work piece engaging member 40 when necessary can be rotated relative to support arm 34. Turning particularly to FIG. 11, it should be noted that yieldably deformable sleeve portion 46 of the work piece engaging assemblage contacts the work piece "WP" at a substantially single point of contact 47. (See also FIG. 9)

Figure 9:
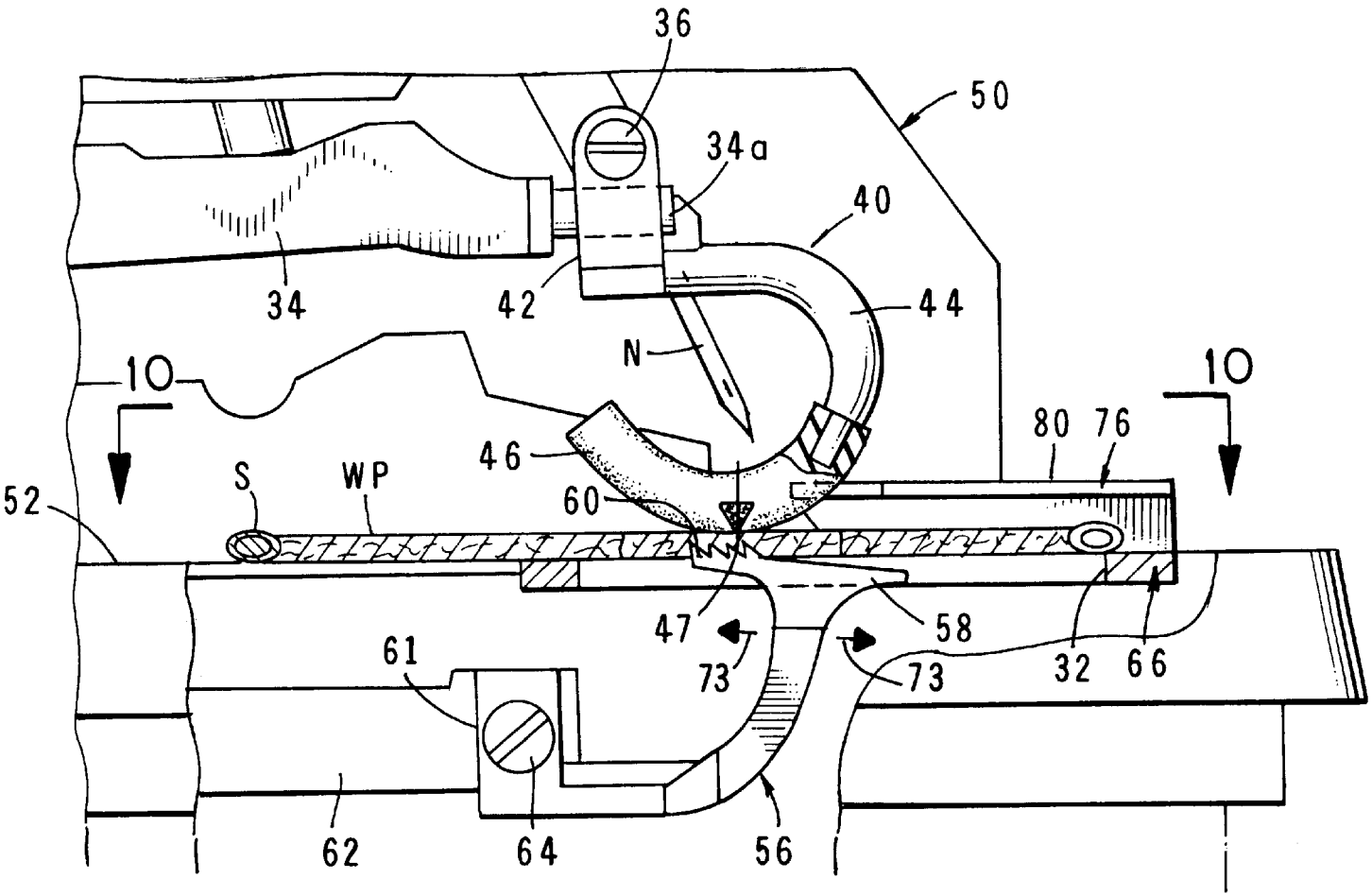
FIG. 9 is an enlarged, fragmentary view of the apparatus of the invention shown partly in cross-section to illustrate the action of the presser foot upon an emblem or patch member which is to be stitched.

Turning to FIGS. 9, 10 and 11 it is also to be observed that regardless of the shape and thickness of the work piece, whether it be round as shown in FIG. 7, oval as shown in FIG. 10, or substantially rectangular as shown in FIG. 11, the point of contact 47 between the work piece engaging member 40 and the work piece is within the central portion of the work piece at a location approximate needle "N" of the apparatus.

Referring to FIG. 7, the apparatus of the invention includes a housing generally designated by the numeral 50 which includes a work surface 52, which supports the work piece "WP" on which the peripheral stitches "S" are to be formed. Housing 50 supports the previously mentioned needle "N" and also houses conventional means for moving the needle between an advanced and a retracted position relative to the work surface 52. Also disposed within housing 50 are conventional means for supplying thread to the needle operating means and means for operating the feed dogs of the apparatus. These later mentioned means are of a character well known to those skilled in the art and are found in one form or another in the majority of commercially available motor powered sewing machines. Detailed manuals describing the construction and operation of these components of the baseline machine are available from the Juki Company.

Following removal of the unnecessary parts including the baseline presser foot assembly and replacing it with work piece engaging member 40, the next step in the method of the invention comprises of removing from the base line device the main feed dog 16, the auxiliary feed dog 18, and a differential feed dog 20. (See FIGS. 1 & 2) This done, the main feed dog and the auxiliary feed dog are discarded and the differential feed dog is modified to produce a modified feed dog of the configuration shown in FIG. 5. This modified feed dog which is generally designated in the drawings by the numeral 56, has only a single upstanding row of teeth 58 which carries a relatively small number of linearly aligned teeth 60. In accordance with one form of the method of the invention, modified feed dog 56 is produced by removing from prior art feed dog 20 the entire row of teeth 26 and by cutting from row 28 a number of the teeth formed proximate the right hand extremity of row 28 as viewed in FIG. 1. It is to be noted that modified feed dog 56 includes a connector portion 60 which is substantially identical to connector portion 20*a* of prior art feed dog 20 (FIG. 1). With this construction it is a simple matter to reinstall modified feed dog 56 into the apparatus housing 50 in the manner shown in FIG. 8. More particularly, modified feed dog 56 is held in position on a connector arm 62 by means of a set screw 64 (FIG. 9).

Prior to installing modified feed dog 56, throat plate 14 (FIG. 1) is removed from the housing 56 of the apparatus and is replaced by the modified throat plate generally identified in FIG. 4 by the numeral 66. Once again it is to be observed that modified throat plate 66 is of a similar construction to prior art plate 14 and, in one form of method of the invention, prior art throat plate 14 is in fact provided by modifying the throat plate 66 of the baseline machine (see FIG. 4). This modification includes several steps including the filling of slot 30 with a suitable fill material which is generally designated in FIG. 4 by the numeral 70. This step substantially closes slot 30 but keeps slot 32 open for receipt of teeth 60 of modified feed dog 56 in the manner shown in FIG. 9. More particularly, as shown in FIG. 9, modified feed dog 56 is positioned within the apparatus housing so that teeth 60 extend upwardly through slot 32 and into engagement with the under surface of the work piece "WP". With this construction teeth 60 tend to engage the work piece and move the work piece forwardly of the apparatus as the modified feed dog reciprocates in the manner indicated by the arrows 73 in FIG. 9.

Another extremely important modification to throat plate 14 comprises the addition to the throat plate of guide means for guiding the work piece relative to the needle "N". In the form of the invention shown in the drawings this guide means comprises a guide fence 76 which comprises a side portion 78 and a top portion 80 which overlays at least a portion of feed dog receiving slot 32. With this construction, guide fence 76 not only engages and guides the peripheral edge of the work piece, but also prevents the work piece from deforming or buckling upwardly relative to the work surface during the stitching operation.

It is to be understood that in constructing the apparatus of the invention, the prior art throat plate 14 can be modified in a manner discussed in the preceding paragraph or, alternatively, a new throat plate of the configuration shown in FIG. 4 can be constructed. As indicated in the drawings, throat plate 66 includes connector receiving apertures 82 and 84 which are formed in the throat plate at the same locations as connector receiving apertures 14*a* and 14*b* of the prior art, baseline throat plate. This of course permits the modified throat plate to be interconnected with the work surface 52 using the same connectors as are used to connect the baseline throat plate 14 with the housing of the sewing machine.

Turning once again to FIG. 7 and 8 it is to be observed that the base line device includes biasing means for biasing support arm 34 downwardly toward work surface 52. This biasing means includes the previously identified coil spring 24 (FIG. 2). Also forming a part of the biasing means of the apparatus is adjustment means for adjusting the tension of the biasing spring so at to thereby adjust the amount of downward force being exerted on the support arm 34. This adjustment means comprises a rotatable knob 88 which is threadably connected to a spring receiving tube 90, which is, in turn, carried within housing 50.

Figure 8:
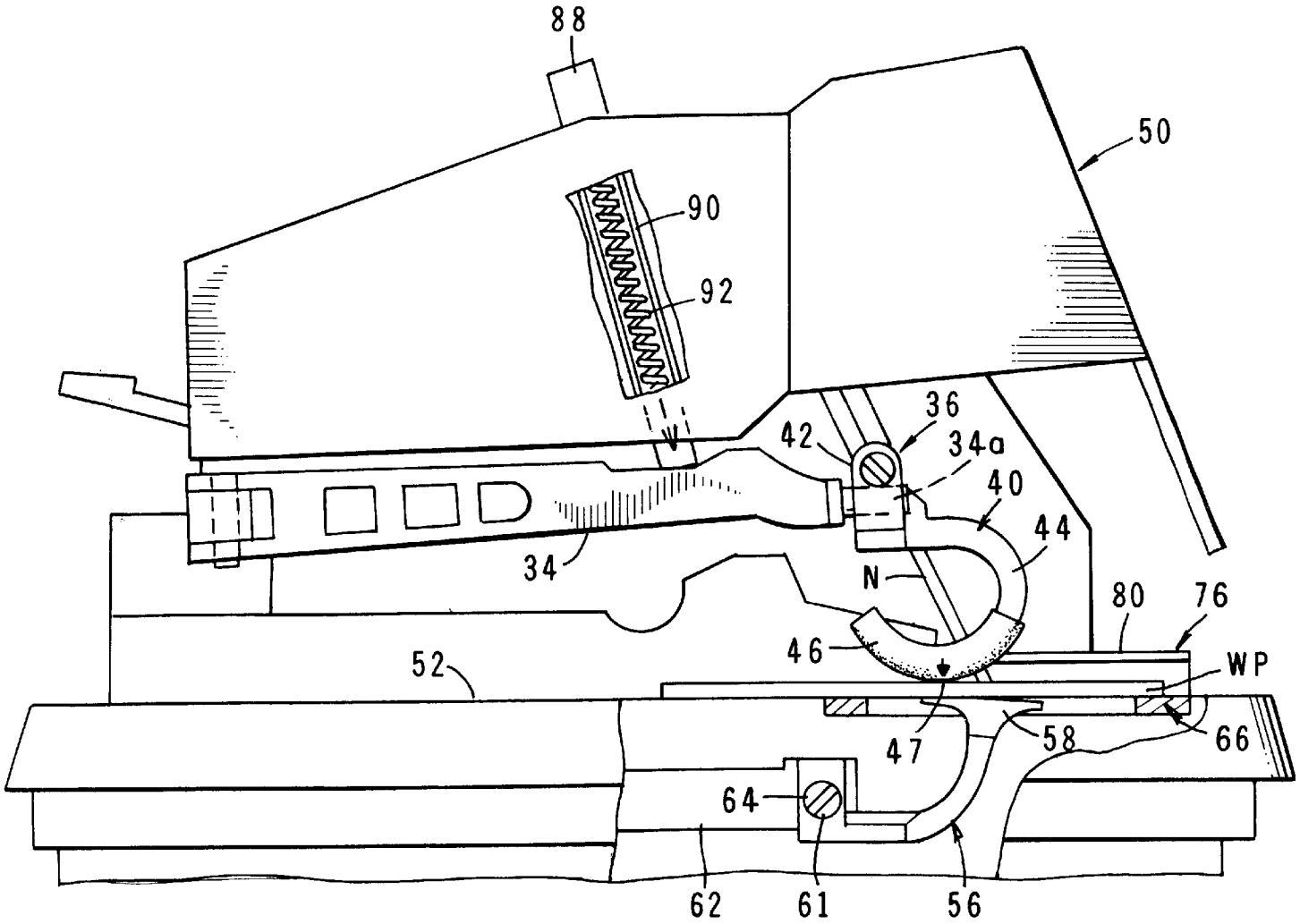
FIG. 8 is a side elevational view of the apparatus shown in FIG. 7.

Another step in the method of the present invention involves the removal of the coil spring 24 and the replacement thereof with a modified coil spring 92 which is of the character shown FIGS. 6 and 8 of the drawings. Modified biasing spring 92 is of similar construction to spring 24, but is a much lighter spring which imposes substantially less biasing forces on support arm 34 than does the stiffer baseline biasing spring 24. Accordingly, use of the modified spring 92 in the apparatus of the invention permits a lighter force to be imposed on the work piece "WP" by work piece engaging member 40 than would be possible if spring 24 were not replaced with the modified biasing means or spring 92.

In accordance with the form of the method of the invention as described in the preceding paragraphs, the improved motor powered sewing apparatus of the character illustrated in FIG. 7 through 12 is produced. This improved motor powered sewing apparatus of the invention includes a housing 50 having work surface 52 and the previously identified needle "N" which moves between an advanced and retracted position in the manner indicated in FIGS. 8 and 9. The apparatus, of course, includes the baseline machine means for moving the needle between the advanced and retracted position and also includes the baseline machine means for supplying needle to the thread. As previously mentioned, these means are of a character well known to those skilled in the art and are included in the base line machine manufactured and sold by the Venus Company. Additionally, the base line apparatus includes operating means for operating the feed dogs which function to move the work piece forwardly of the work surface. These latter means are also well understood by those skilled in the art.

In summary, the improvements to the baseline, power-operated sewing machine comprise the addition to the machine of the work piece engaging member 40, the modified feed dog 56 having a single row of work piece engaging teeth 60, and the modified throat plate 76. The modified throat plate 76 includes a slot for receiving the single row of work piece engaging teeth 60 and novel guide means for guiding the travel of the work piece relative to the needle "N". As previously mentioned, this important guide means includes the guide fence 76 which has side walls 78 and a top wall 80 which overlays at least a portion of the feed dog receiving slot that is formed in the modified throat plate. Additionally the improved apparatus includes biasing means, here provided in the form of coil spring 92. Coil spring 92 is carried by housing 50 and functions to bias the work piece engaging member 40 in a downward direction toward the work surface 52 when the work piece is in the starting position, as the biasing means urges work piece engaging member 40 downwardly toward the work piece in the manner shown in FIGS. 8 and 9. In this regard, it is to be observed that member 40 uniquely engages the work piece at a substantially single point of contact (see also FIG. 11). As the work piece engaging assembly 40 is biased downwardly against the work piece "WP", the yieldably deformable to a degree end portion 46 of the assembly will tend to flex or yieldably deform to a degree sufficient to accommodate work pieces of various thickness. Further, the amount of force exerted by the work piece engaging assembly 40 on the work piece can be finely adjusted by the adjustment means or knob 80 of the apparatus which adjustment means varies the amount of force being exerted by the replacement spring 92 on the support arm 34 and in turn on the work piece engaging assembly 40.

With the work piece engaging member in contact with the work piece "WP" in the manner indicated in FIGS. 10 and 11, operation of the feed dog operating means will cause reciprocal movement of modified feed dog 56 back and forth in the direction of the arrows 73 of FIG. 9. This reciprocal movement of the modified feed dog will urge the work piece to move forwardly or to the left as viewed in FIG. 9. However, because the work piece engaging member 40 is exerting a substantially point contact, downward pressure on work piece "WP", as the feed dog urges the work piece forwardly the work piece will tend to rotate about the contact point and move into pressural engagement with guide fence 76. In this manner, the peripheral portion of the work piece is correctly aligned with and moves under needle "N" in the manner illustrated in FIGS. 10 and 12. Stated another way, the point contact pressure exerted by assemblage 40 on the work piece acts as a drag so that forces exerted on the work piece by the modified feed dog tending to urge the feed dog forwardly along the work surface will be vectored in the manner to continuously urge the peripheral portion of the work piece into engagement with the guide fence 40 and at the same time cause a rotational movement of the work piece relative to the work surface in the manner indicated by the arrow 95 in FIG. 10. As the peripheral portion of the work piece moves along the guide means and beneath the needle "N" a highly uniform and precisely formed stitch "S" will be formed along the periphery of the work piece in the manner indicated in FIGS. 10 and 12.

Because of the unique cooperative interaction between the work piece engaging member 40, the guide means or fence 76 and the modified feed dog 56, work pieces of virtually any shape can be automatically stitched by the improved apparatus. More particularly, as previously mentioned, the work piece may be round as shown in FIG. 7, may be oval shaped as shown in FIG. 10, may be generally rectangular as shown in FIG. 12 or may even be of the tear-drop shaped configuration shown in FIG. 13. Regardless the shape of the work piece the drag imposed on the work piece by the work piece engaging assemblage 40 will urge the peripheral portion of the work piece continuously against the guide fence 70 as the modified feed dog controllably urges the work piece forwardly of the work surface 52. In those instances where the work piece is not uniformly feeding past the needle, the adjustment means 80 can be operated to adjust the drag imposed by the presser foot. This is readily accomplished by either the increasing or decreasing the forces exerted on connector arm 34 and in turn on the work piece by yieldably deformable foot portion 46.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A method of making a sewing apparatus for automatically stitching along the periphery of a work piece, the work piece having an inner portion circumscribed by the periphery, by modifying a baseline sewing machine having a housing, a work surface; a needle moving between an advanced and retracted position relative to the work surface; a throat plate connected to the housing, the throat plate having first and second spaced apart feed dog receiving slots formed therein; a presser foot disposed above the work surface; a biasing spring for continuously urging the presser foot in a direction toward the work surface; and a main feed dog, an auxiliary feed dog and a differential feed dog disposed below the work surface for advancing the work piece relative to the needle, the differential feed dog having first and second spaced apart rows of work piece engaging teeth receivable respectively within the first and second feed dog receiving slots formed in the throat plate; the method comprising the steps of:

(a) removing the presser foot of the baseline machine and replacing it with a work piece engaging member having a surface for pressurally engaging the inner portion of the work piece at substantially a single point of contact; and (b) adding to the baseline sewing machine guide means for guiding travel of the work piece relative to the needle.

2. A method as described in claim 1 including the further step of removing from the differential feed dog of the baseline one of the first and second rows of teeth.

3. A method as described in claim 1 including the further step of removing the biasing spring from the baseline machine and replacing it with a lighter tensioned biasing spring.

4. A method defined in claim 1 in which said work piece engaging member includes a yieldably deformable member having a curved surface for engaging the inner portion of the work piece at a point along said curved surface.

5. A method as defined in claim 1 including the further step of removing the main feed dog and the auxiliary feed dog from the baseline machine.

6. A method as defined in claim 5 including the further step of filling with a filler material one of the first and second feed dog receiving slots formed in the throat plate.

7. A method of making a sewing apparatus for automatically stitching along the periphery of a work piece, the work piece having an inner portion circumscribed by the periphery, by modifying a baseline motor driven sewing machine having a work surface; a needle moving between an advanced and retracted position relative to the work surface; a throat plate connected to the work surface, the throat plate having first and second spaced apart feed dog slots formed therein; a presser foot disposed above the work surface; a biasing spring for continuously urging the presser foot in a direction toward the work surface; and a main feed dog, an auxiliary feed dog and a differential feed dog disposed below the work surface for advancing the work piece relative to the needle, the differential feed dog having first and second spaced apart rows of work piece engaging teeth receivable respectively within the first and second feed dog receiving slots formed in the throat plate; the method comprising the steps of:

(a) removing the throat plate from the baseline machine and replacing it with a modified throat plate having at least one feed dog receiving slot and including guide means for guiding travel of the work piece relative to the needle;

(b) removing the presser foot from the baseline machine and replacing it with a work piece engaging member having surfaces for engaging the inner portion of the work piece in at least substantially a single point of contact;

(c) removing from the differential feed dog of the baseline machine one of the first and second rows of teeth to form a modified differential feed dog having a single row of teeth.

8. A method as described in claim 7 including the further step of removing the biasing spring from the baseline machine and replacing it with a lighter tensioned biasing spring.

9. A method as defined in claim 7 including the further step of removing the main feed dog and the auxiliary feed dog from the baseline machine.

10. A method as defined in claim 7 in which said work piece engaging member includes a connector portion and a curved body portion connected to said connector portion, said surface for engaging the inner portion of the work piece comprising a surface formed on a yieldably deformable pressure imparting member connected to said body portion.

11. A method as defined in claim 7 including the further step of removing from said single row of teeth of said modified differential feed dog a plurality of teeth.

12. A method as defined in claim 7 in which said guide means of said modified throat plate comprises a guide fence having a side wall and a top wall, said top wall overlaying at least a portion of said at least one feed dog receiving slot.

13. A method as defined in claim 12 in which said guide fence of said throat plate is constructed and arranged so that said side wall is continuously engaged by the periphery of the work piece.

14. A motor powered sewing apparatus for automatically stitching along the boarder of a work piece having an inner portion circumscribed by the border, said apparatus having a housing, including a work surface; a needle moving between an advanced and retracted position relative to the work surface and a support arm for supporting a presser foot, the improvement comprising:

(a) a work piece engaging member connected to the support arm for engaging the work piece, said work piece engaging member having a surface for engaging the central portion of the work piece at a substantially a single point of contact;

(b) a feed dog operably connected to the operating means, said feed dog having a single row of work piece engaging teeth; and (c) a throat plate connected to the work surface, said throat plate having a slot for receiving said single row of work piece engaging teeth and being provided with guide means for guiding the travel for the work piece relative to the needle.

15. The apparatus as defined in claim 14 in which said guide means of said throat plate comprises a guide fence having a side wall and a top wall overlaying at least a portion of said slot.

16. The apparatus as defined in claim 14 further including biasing means carried by the housing for biasing said work piece engaging member toward the work surface.

17. The apparatus as defined in claim 14 in which said work piece engaging member includes a connector portion for interconnection with the support arm and a curved body portion connected to said connector portion, said surface of said member for engaging the central portion of the work piece comprising a curved surface formed on a yieldably deformable member connected to said curved body portion.

18. The apparatus as defined in claim 17 in which said yieldably deformable member comprises and elastomeric sleeve receivable over a portion of said curved body portion.

19. The apparatus as defined in claim 17 in which said connector portion is pivotally connected to said support arm.

20. The apparatus as defined in claim 17 further including biasing means carried by the housing for biasing said yieldably deformable member against the work piece.

* * * * *